US010344565B2

(12) United States Patent
Felten et al.

(10) Patent No.: US 10,344,565 B2
(45) Date of Patent: Jul. 9, 2019

(54) MIXING AND DISPERSION OF A TREATMENT CHEMICAL IN A DOWN HOLE INJECTION SYSTEM

(71) Applicant: HALLIBURTON ENERGY SERVICES, INC., Houston, TX (US)

(72) Inventors: Frederic Nicolas Felten, Corinth, TX (US); Paul Anthony Haines, Montgomery, TX (US); Ammar Abdilghanie Mohammed, Sharjah (AE)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 16/120,968

(22) Filed: Sep. 4, 2018

(65) Prior Publication Data

US 2018/0371872 A1 Dec. 27, 2018

Related U.S. Application Data

(62) Division of application No. 15/128,382, filed as application No. PCT/US2015/060262 on Nov. 12, 2015, now Pat. No. 10,072,479.

(51) Int. Cl.
*E21B 37/06* (2006.01)
*E21B 17/00* (2006.01)
(Continued)

(52) U.S. Cl.
CPC ..... *E21B 37/06* (2013.01); *E21B 17/00* (2013.01); *E21B 43/12* (2013.01); *E21B 43/16* (2013.01)

(58) Field of Classification Search
CPC ..... E21B 17/00; E21B 37/06; E21B 43/12; E21B 43/16
See application file for complete search history.

(56) References Cited

U.S. PATENT DOCUMENTS 4,806,172 A * 2/1989 Adaci ..... B08B 3/028 134/34
5,195,585 A * 3/1993 Clemens ..... E21B 37/00 166/222

(Continued)

FOREIGN PATENT DOCUMENTS

WO 2014077814 A1 5/2014
WO WO-2014077814 A1 * 5/2014 ..... E21B 34/06

OTHER PUBLICATIONS

International Search Report and Written Opinion; PCT Application No. PCT/US2015/060262; dated Aug. 12, 2016.

*Primary Examiner* — Caroline N Butcher
(74) *Attorney, Agent, or Firm* — Polsinelli PC

(57) ABSTRACT

A downhole chemical injection system that may include at least a first and a second injection port. The first injection port may be fluidically coupled with a chemical injection line and fluidically coupled with a production tubing string to inject the chemical into the production tubing string. Similarly, the second injection port may be fluidically coupled with the chemical injection line and fluidically coupled with the production tubing string to inject the chemical into the production tubing string. The first injection port may include at least a first radially extending injection nozzle, extending injection nozzle extending in a first radial direction relative to a central axis of the production tubing string. Similarly, the second injection port may include at least a second radially extending injection nozzle, extending in a second radial direction relative to the central axis of the production tubing string.

9 Claims, 15 Drawing Sheets

(51) Int. Cl.
*E21B 43/12* (2006.01)
*E21B 43/16* (2006.01)

(56) References Cited

U.S. PATENT DOCUMENTS

| | | | |
|---|---|---|---|
| 2005/0035224 | A1 | 2/2005 | Dodd |
| 2008/0142226 | A1 | 6/2008 | Wilson |
| 2009/0008083 | A1 | 1/2009 | Themig et al. |
| 2013/0168099 | A1 | 7/2013 | Themig |
| 2013/0248189 | A1 | 9/2013 | Brekke |

* cited by examiner

MIXING AND DISPERSION OF A TREATMENT CHEMICAL IN A DOWN HOLE INJECTION SYSTEM

This application is a Divisional of U.S. Application No. 15/128,382, filed Sep. 22, 2016, which was the national stage entry of international application PCT/US2015/060262 filed Nov. 12, 2015, said each application is expressly incorporated herein in its entirety.

FIELD

The disclosure relates generally to downhole chemical injection systems and more particularly to downhole chemical injection systems having a plurality of injection ports.

BACKGROUND

Many fluids within a wellbore contain various inorganic compounds. Such compounds have the tendency to deposit on metallic components including tubulars or casing downhole, and which is referred to as scale. Various measures, including chemical treatments, are taken to remove scale as well as prevent its build-up in downhole components. For example, a treatment chemical may be injected into a downhole production tubing string, for example, to reduce scale deposition and buildup and thus preserve the life of downhole components and improve processes and production. Additionally, any of a variety of special-purpose treatment chemicals may be injected into a downhole production tubing string for various purposes.

BRIEF DESCRIPTION OF THE DRAWINGS

These and other features, aspects, and advantages of the present disclosure will become better understood with reference to the following description and appended claims, and accompanying drawings where:

Figure 1:
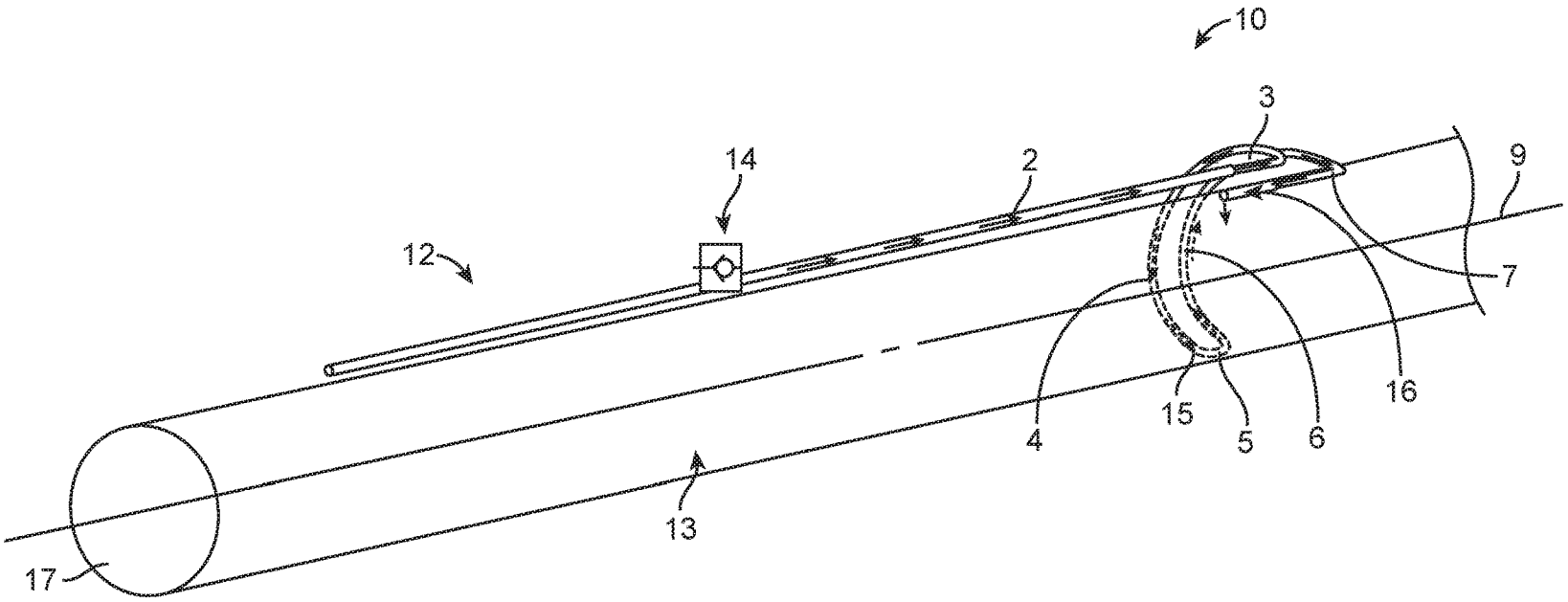
FIG. 1: is a schematic perspective-view diagram of downhole chemical injection system having a density barrier terminating in a single injection port for delivering a chemical into a tubing string.

It should be understood that the various embodiments are not limited to the arrangements and instrumentality shown in the drawings.

DETAILED DESCRIPTION

The present disclosure may be understood more readily by reference to the following detailed description of preferred embodiments of the disclosure as well as to the examples included therein. All numeric values are herein assumed to be modified by the term "about," whether or not explicitly indicated. The term "about" generally refers to a range of numbers that one of skill in the art would consider equivalent to the recited value (i.e., having the same function or result). In many instances, the term "about" may include numbers that are rounded to the nearest significant figure. Unless otherwise specified, any use of any form of the term "couple," or any other term describing an interaction between elements is not meant to limit the interaction to direct interaction between the elements and also may include indirect interaction between the elements described.

Disclosed herein is a downhole chemical injection system which improves chemical distribution of a scale inhibiting treatment chemical over production tubing string walls and which may reduce scale deposition and buildup. The injection system includes a plurality of injection ports disposed about the circumference of a tubular production string for delivering a chemical, such as scale removers or inhibitors, into the production tubing string. As a result of the improved distribution of scale inhibiting treatment, potential production losses can be minimized such as the need for costly remedial services.

FIG. 1 is a schematic perspective-view diagram of downhole chemical injection system 10 having a density barrier 15 terminating in a single injection port 16 for delivering a chemical 2 into the inner bore 17 of a production tubing string 13, having a central axis 9. A chemical 2 may be pumped into a chemical injection line 12. The chemical injection line 12 may optionally include a check valve 14 and a density barrier 15. The check valve 14 may prevent wellbore fluids, such as production gas, oil or water, from migrating into the chemical injection system upstream of the check valve 14. Various density barriers are known in the art.

The concept of a density barrier for downhole chemical injection is a safe and effective means for injection of treatment chemicals from a surface installation down to a production tubing string while preventing or minimizing any possible migration of production fluid back into a chemical injection line through injection ports.

The density barrier 14, illustrated in FIG. 1 includes a first substantially axially extending tubing section 3, a first substantially circumferentially extending tubing section 4, a second substantially axially extending tubing section 5, a second substantially circumferentially extending tubing section 6, and a third substantially axially extending tubing section 7. As used herein, the term "axial" refers to a direction that is generally parallel to a central axis of the production tubing string at a location, for example, at the location of the density barrier 15. As used herein, the term "radial" refers to a direction that extends generally outwardly from and is generally perpendicular to the central axis of the production tubing string at a location, for example, at the location of the density barrier 15. As used herein, the term "circumferential" refers to a direction generally perpendicular to the radial direction and the axial direction at any point around the circumference of the production tubing string 13. Together, the three substantially axially extending tubing sections form an "axial loop." More specifically, the first substantially axially extending tubing section 3, the second substantially axially extending tubing section 5, and the third substantially axially extending tubing section 7 form an axial loop. Similarly, the two substantially circumferentially extending tubing sections form a "circumferential loop." More specifically, the first substantially circumferentially extending tubing section 4, and the second substantially circumferentially extending tubing section 6 form a circumferential loop. Therefore, the density barrier 15 may be fluidically positioned between the check valve 14 and the injection port 16, may include an axial loop and a circumferentially loop. The density barrier 15 may prevent, limit, restrict, or minimize migration of production fluid from the injection port to the check valve regardless of the directional orientation of the well. In all embodiments described herein, the check valve 14 and the density barrier 15 are optional. In general, however, a density barrier may be achieved by providing multiple axial and circumferential loops in the chemical injection line, which typically has a small diameter relative to the production tubing string. The circumferential and axial loops may optionally be disposed on a mandrel that partially or completely surrounds the production tubing string 13. The mandrel merely provides structural support for the smaller diameter tubing that makes up the chemical injection line 12 and the density barrier 15.

Still referring to FIG. 1, after passing through check valve 14 and density barrier 15, an injected chemical 2, such as a scale inhibitor, may be injected into production tubing string 13 via an injection port 16. The injection port 16 may tap or penetrate the exterior surface of the production tubing string 13, providing access to the interior thereof.

In some cases, the injected chemical can be a scale inhibitor or scale remover. Suitable scale inhibitors or scale removers include, but are not limited to, phosphates, phosphate esters, phosphoric acid, phosphonates, phosphonic acid, phosphonate/phosphonic acids, polyacrylamides, salts of acrylamido-methyl propane sulfonate/acrylic acid copolymers (AMPS/AA), phosphinated maleic copolymers (PHOS/MA), salts of a polymaleic acid/acrylic acid/acrylamido-methyl propane sulfonate terpolymer (PMA/AMPS) as well as mixtures thereof. Other suitable scale removers can include acidic treatment agents, including, but not limited to mineral acids, weak organic acids, hydrochloric acid, phosphoric acid, acetic acid, formic acid, and any mixture thereof. In some cases, the injected chemical can be a caustic scale removal agents.

Figure 2:
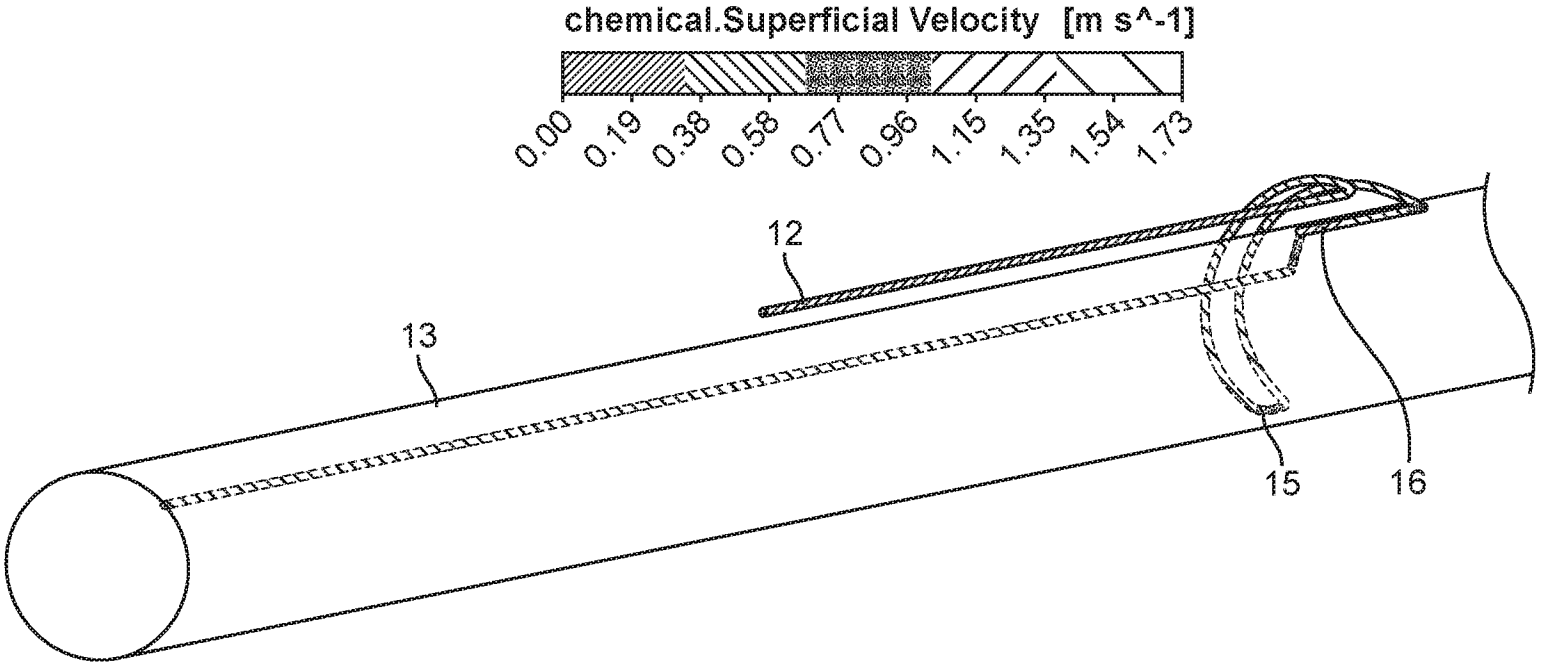
FIG. 2: is a diagram showing a computation fluid dynamics (CFD) simulation of the downhole chemical injection system shown in FIG. 1.

FIG. 2 is a diagram showing a computation fluid dynamics (CFD) simulation of the downhole chemical injection system shown in FIG. 1. In general the CFD simulation shows that the chemical remains confined within a short distance away from the tube walls after injection without any notable mixing in both the radial and circumferential directions. Without wishing to be bound by theory, it is believed that this confinement is because mixing is operative mainly through the chemical diffusion process that is associated with very long time scales and hence it takes a very long distance downstream of the injection port until any significant mixing between the injected chemical and the production fluid takes effect. As shown in FIG. 2, the velocity of the injected chemical 2 is from about 0.00 to about 0.19 m/s in a region of the chemical injection line 12 prior to the density barrier 15. In the density barrier 15, the velocity of the injected chemical 2 increases to about 0.19 to about 0.77 m/s. Upon entering the injection port 16, the velocity of the injected chemical 2 may slow to from about 0.00 to about 0.19 m/s. The velocity of the injected chemical reaches a maximum at the outlet or the injection nozzle of the injection port 16 to be in a range of from about 0.58 to about 0.96 m/s. After being injected into the production tubing string 13, the injected chemical 2 encounters the well-bore fluid and may be pinned between the well-bore fluid and the inner wall of the production tubing string 13. The velocity of the injected chemical along the inner wall of the production tubing string may be in a range from about 0.19 to about 0.38 m/s, here mixing occurs due to the slow chemical diffusion process already discussed.

Various embodiments provide more optimized mixing and/or distribution of injected chemical over the internal circumference of a production tubing string. As will be discussed in greater detail, a variety of injection ports, injection nozzles, and injection tips may be employed alone or in combination.

Figure 3:
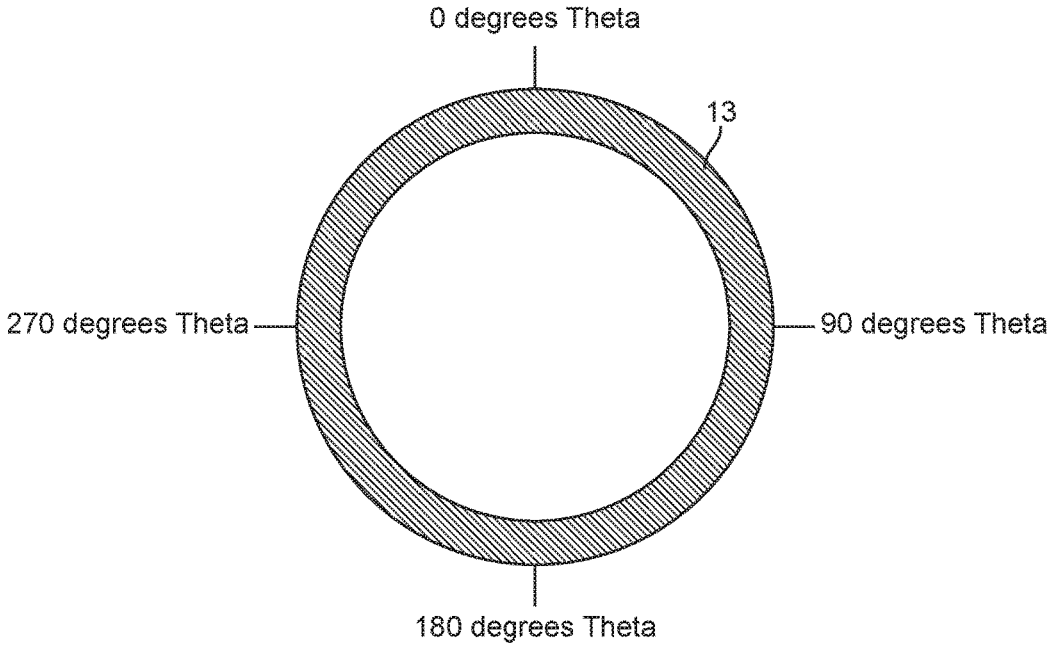
FIG. 3: is a schematic cross-sectional diagram of a tubing string illustrating an angular convention (theta) used through the present disclosure.

FIG. 3 is a schematic cross-sectional diagram of a production tubing string 13 illustrating an angular convention (theta) used through the present disclosure. These conventions are arbitrary and are used only for convenient reference between relative portions along the inner and/or outer circumference of the production tubing string 13. Theta (θ) is defined as 0 degrees at the top of the cross-section of the production tubing string 13. Theta (θ) increases in a clockwise direction around the circumference of the production tubing string.

Figure 4:
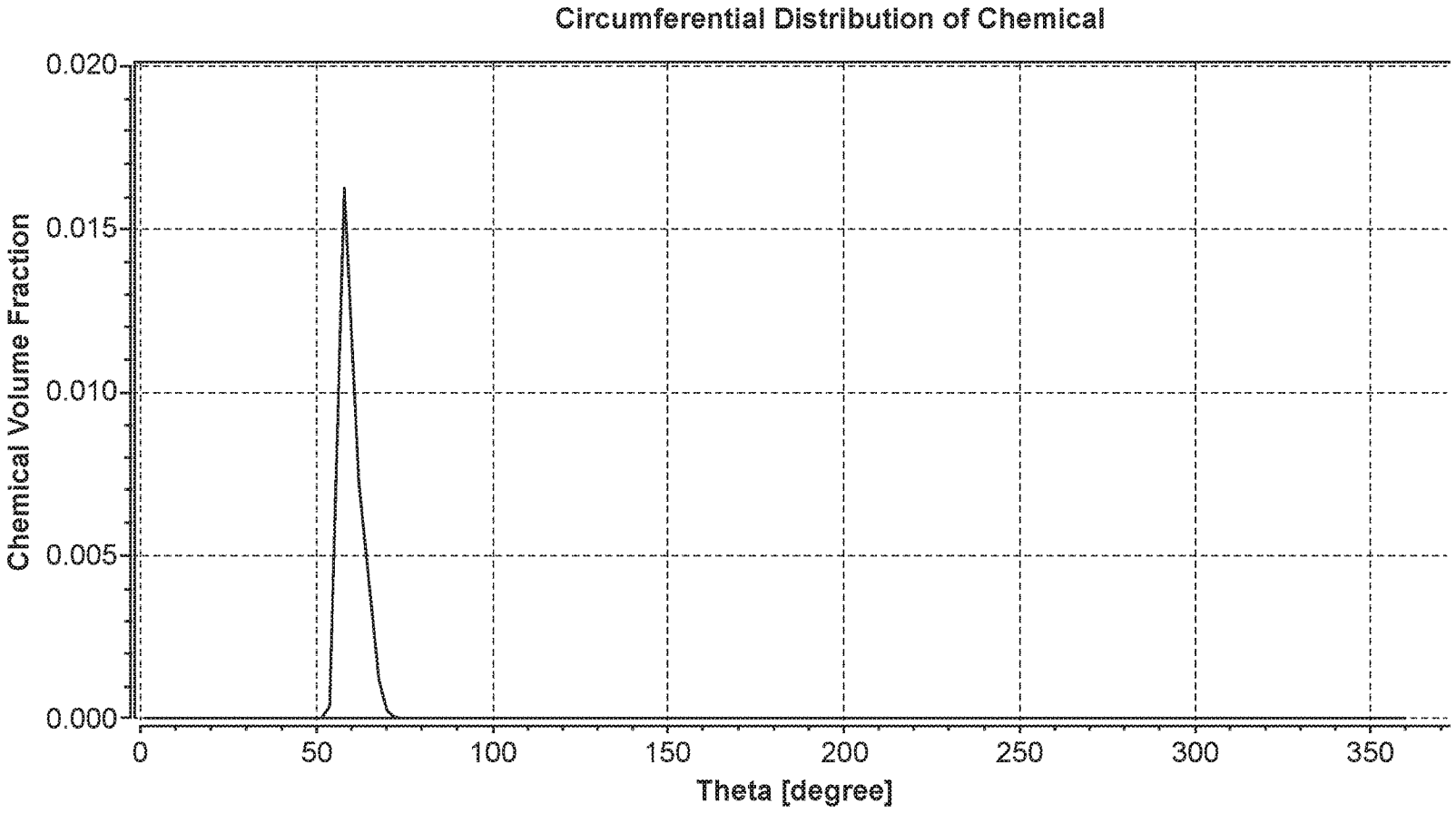
FIG. 4: is a plot of chemical volume fraction versus theta showing the circumferential distribution of an injected chemical along an inner circumference of a tubing string via a single injection port.

FIG. 4 is a plot of chemical volume fraction versus theta showing the circumferential distribution of an injected chemical along an inner circumference of a production tubing string 13 via a single injection port 16. More specifically, this plot shows the chemical volume fraction as a function of the circumferential angle, from 0 to 360 degrees theta, for the single port design on a transverse plane, one foot downstream of the injection port. As can be seen in the figure, the chemical volume fraction is distributed relatively narrowly around the injection point at about 60 degrees theta. A single injection point, therefore, may or may not provide sufficient distribution of the injected chemical 2 around the full internal circumference of the production tubing string 13. It may be desirable in certain circumstances to provide a wider distribution of the injected chemical. Injecting a chemical at a single point may not be optimized for efficient mixing of the chemical and the well-bore fluid and/or for a uniform distribution of the injected chemical over the internal circumference of the production tubing string 13. If the injection is not optimized, chemical mixing may rely mainly on slow diffusion processes, leading to non-uniform spatial distribution of the chemical and consequently to a long distance downstream of the injection ports where the chemical is localized over a small circumferential area and the rest of the production tubing string cross section being essentially free of the treatment chemical.

Figure 5:
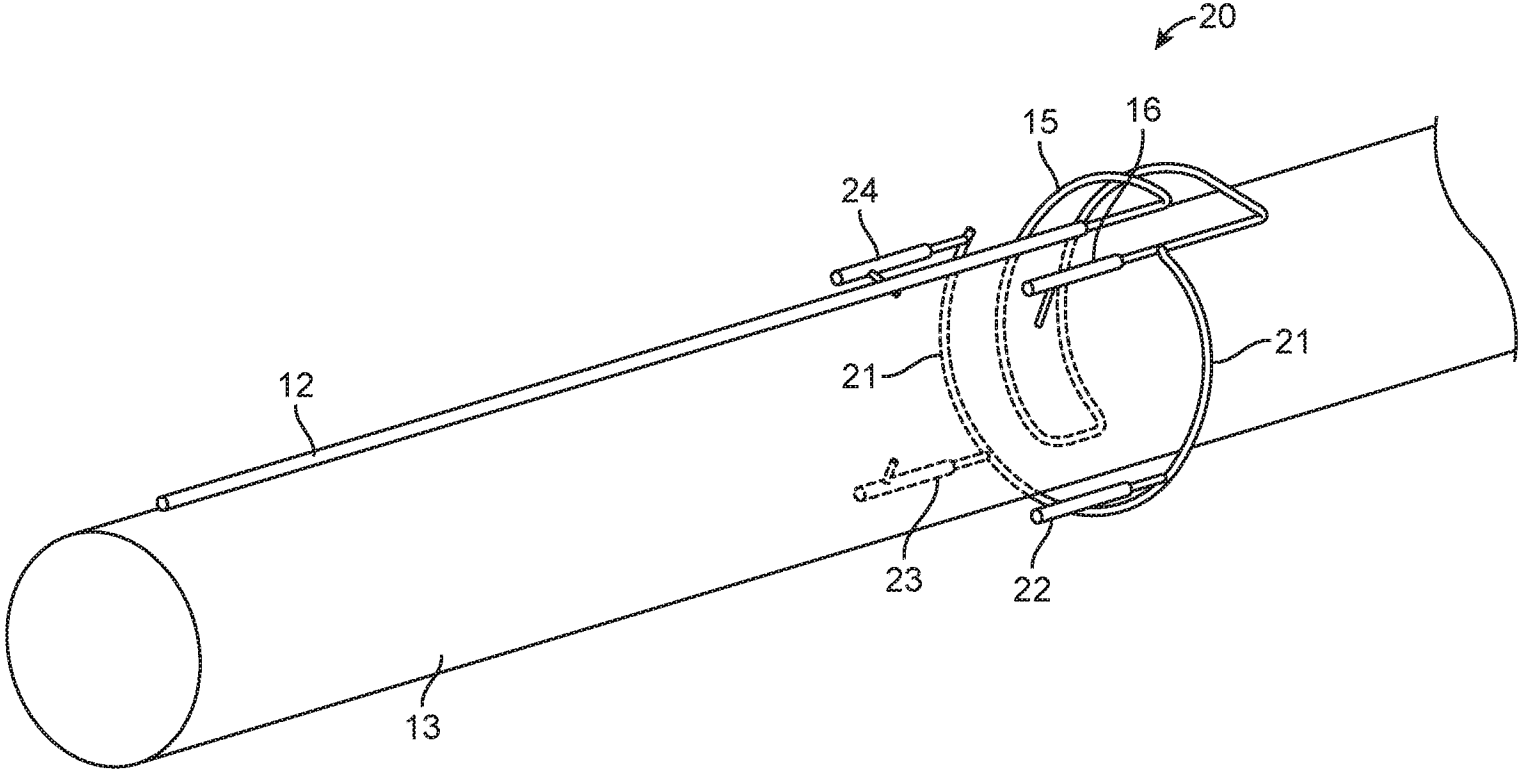
FIG. 5: is a schematic perspective-view diagram of a downhole chemical injection system having a density barrier terminating in a plurality of injection ports for delivering a chemical into a tubing string.

FIG. 5 is a schematic perspective-view diagram of a downhole chemical injection system 20 having a density barrier 15 terminating in a plurality of injection ports for delivering a chemical into a production tubing string 13. The downhole chemical injection system 20 in FIG. 5 is the same as the downhole chemical injection system 10 shown in FIG. 1, except that an extended injection line 21 is added after the optional density barrier 15. When a density barrier is present, the extended injection line 21 may be fluidically coupled with the density barrier 15, for example at the third substantially axially extending tubing section 7. One or more injection ports may be positioned around the circumference of the production tubing 13 and supplied with injection chemical 2 via a fluidic coupling with the extended injection line 21. As shown in FIG. 5, the downhole chemical injection system includes a first injection port 16, a second injection port 22, a third injection port 23, and a fourth injection port 24. Any number of injection ports may be utilized. A plurality of extended injection lines may also be provided as desirable to conveniently supply any additional injection ports with injected chemical 2.

Figure 6:
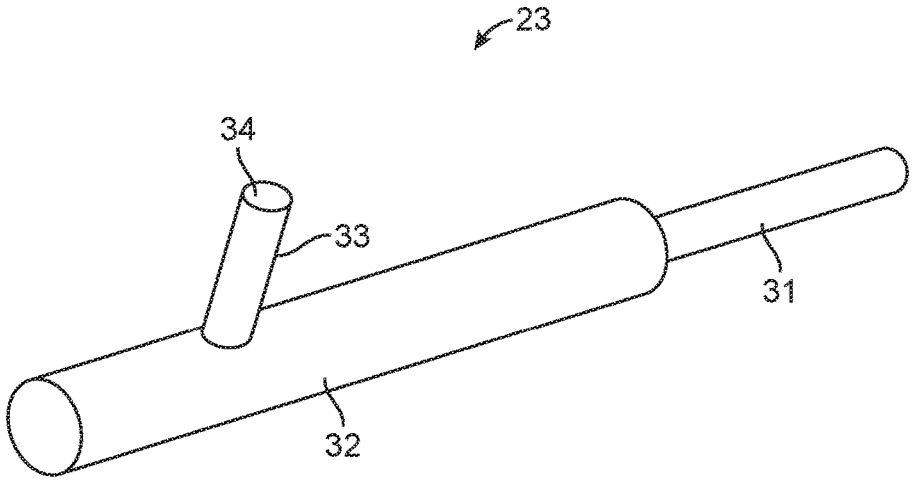
FIG. 6: is a schematic perspective-view diagram of a single injection port.

FIG. 6 is a schematic perspective-view diagram of a single injection port 23. The injection port 23 is fludically coupled with an injection line 31 through which injected chemical 2 may flow. The injection port 23 includes an injection port body 32. The injection port body may take any shape. As shown, the injection port body is substantially cylindrical. The injection port 23 may also include an injection nozzle 33. The injection nozzle 33 may extend in a substantially radial direction relative to a central axis of the injection port body. The injection nozzle 33 may include an injection nozzle tip 34. The injection nozzle tip 34 may be of any suitable size and of any suitable shape. The size and shape of the injection nozzle tip 34 may influence the velocity of the injected chemical 2. A small or narrow injection tip 34 may, for example, increase the velocity of the injected chemical 2. The velocity and flow pattern of the injected chemical 2 will also depend, of course, upon the relative densities of the injected chemical 2 and the well-bore fluid into which the injected chemical 2 is injected.

Figure 7:
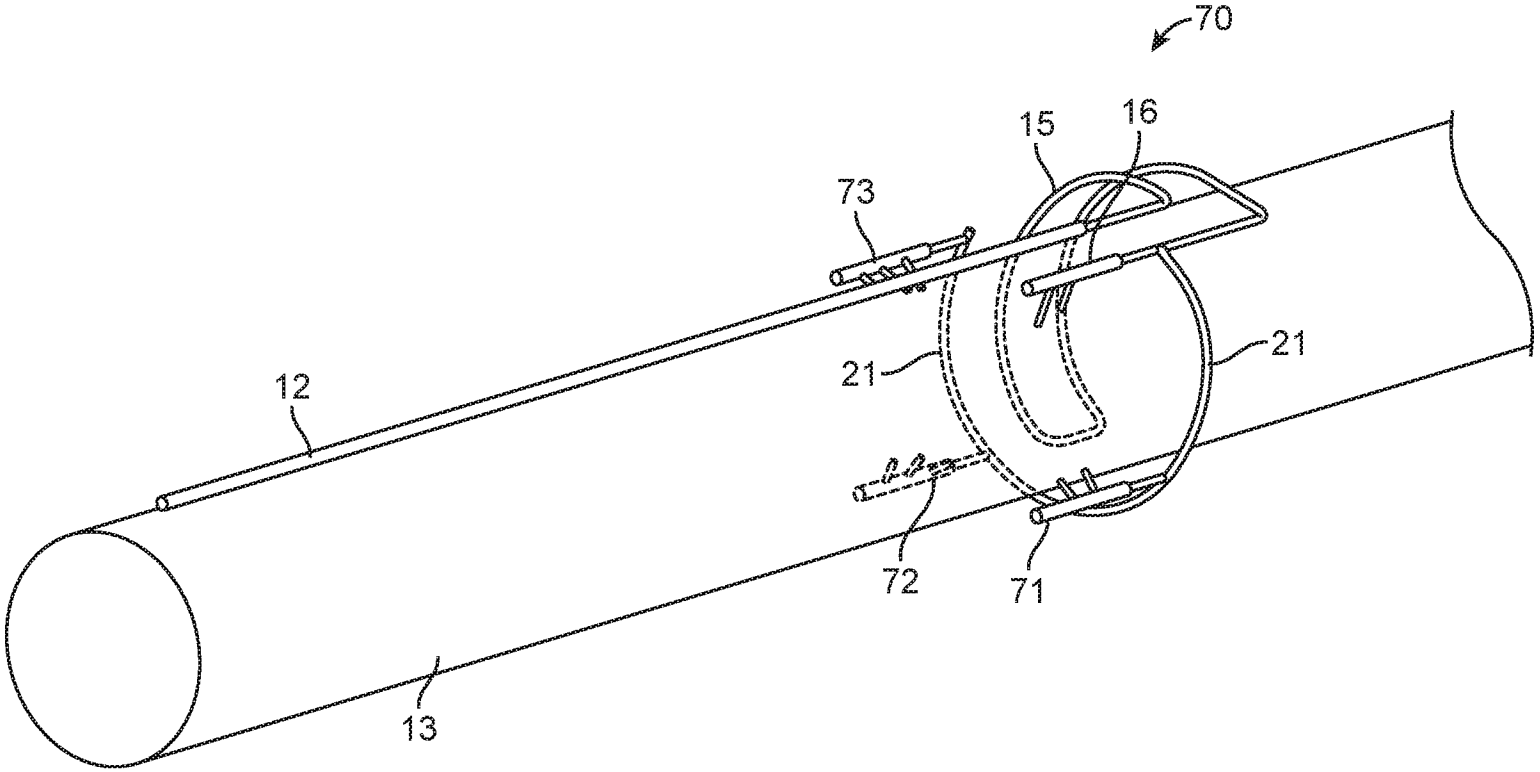
FIG. 7: is a schematic perspective-view diagram of a downhole chemical injection system having a density barrier terminating in a plurality of injection ports, each injection port having a plurality of injection tips; for delivering a chemical into a tubing string.

FIG. 7 is a schematic perspective-view diagram of a downhole chemical injection system 70 having a density barrier 15 terminating in a plurality of injection ports, each injection port having a plurality of injection tips; for delivering a chemical into a production tubing string 13. The downhole chemical injection system 70 in FIG. 7 is the same as the downhole chemical injection system 20 as shown in FIG. 5, except that each of the plurality of injection ports includes a plurality of injection tips or nozzles. For example, the first injection port 16 includes a plurality of injection nozzles; the second injection port 71 includes a plurality of injection nozzles; the third injection port 72 includes a plurality of injection nozzles; and the fourth injection port includes a plurality of injection nozzles. Not all of the plurality of injection ports must include the same number of injection nozzles. Any desirable configuration of injection ports and injection nozzles may be employed to deliver injected chemical 2 to the interior of the production tubing string.

Figure 8A:
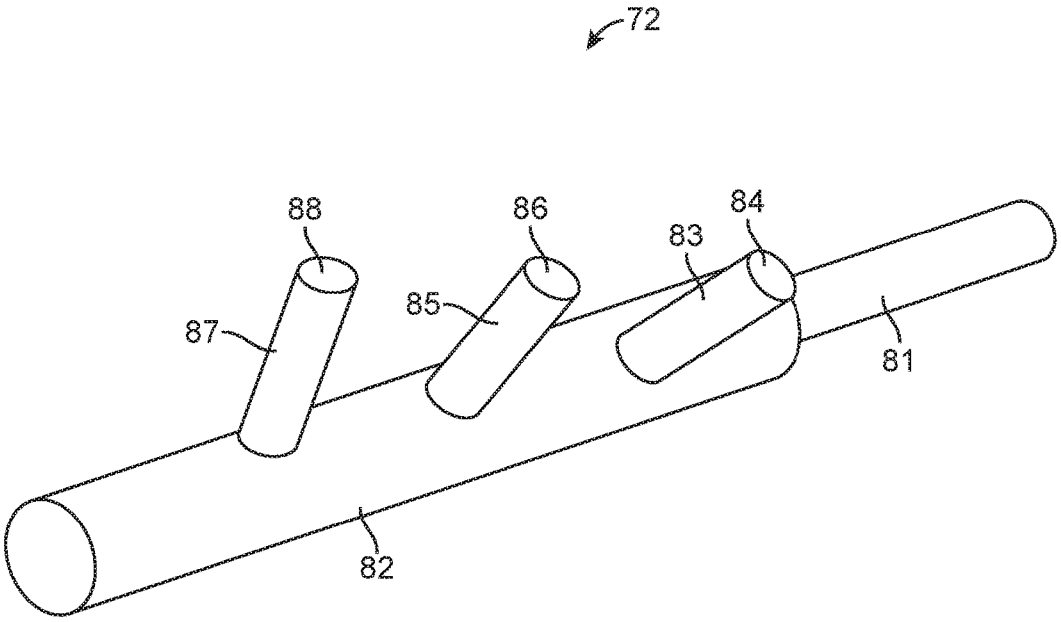
FIG. 8A: is a schematic perspective-view diagram of an injection port having a plurality of injection tips.

FIG. 8A is a schematic perspective-view diagram of an injection port 72 having a plurality of injection nozzles or tips. The injection port 72 is fludically coupled with an injection line 81 through which injected chemical 2 may flow. The injection port 72 includes an injection port body 82. The injection port body may take any shape. As shown, the injection port body is substantially cylindrical. The injection port 72 may also include a plurality of injection nozzles. For example, the injection port 72 may include a first injection nozzle 83, a second injection nozzle 85, and a third injection nozzle 87. Each injection nozzle may extend in a substantially radial direction relative to a central axis of the injection port body. The injection nozzles may be disposed at different angles.

Figure 8B:
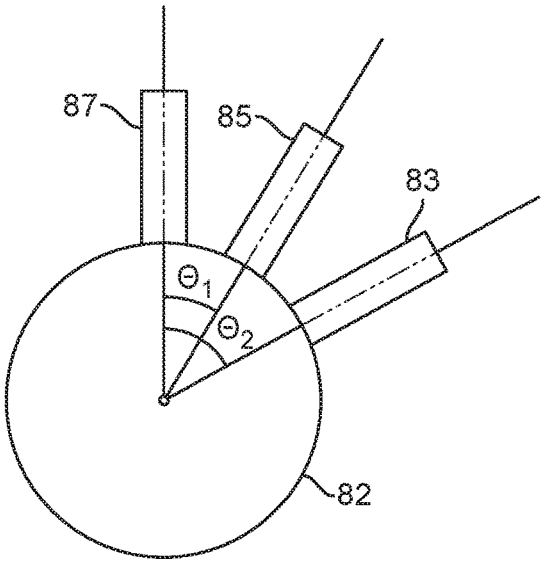
FIG. 8B is a schematic cross-sectional view diagram of the injection port 72 as shown in FIG. 8A.

FIG. 8B is a schematic cross-sectional view diagram of the injection port 72 as shown in FIG. 8A. Similarly, the convention regarding the angle theta as shown in FIG. 3, the angle describing the port theta is defined as 0 degrees at the top of the cross-section of the injection port body 82. Theta increases in a clockwise direction around the circumference of the injection port body 82. The injection port body 82 need not be cylindrical. A similar angular convention may, nevertheless, be employed with respect to a central axis of an arbitrarily shaped injection port body 82. As shown in FIG. 8B, the third injection nozzle 87 is positioned at 0 degrees theta (θ); the second injection nozzle 85 is positioned at a first angle, θ1; and the first injection nozzle 83 is disposed at a second angle, θ2. The injection nozzles of the injection port 82 are, therefore, "circumferentially staggered." As used herein, the term "circumferentially staggered" refers to a plurality of injection nozzles disposed at a plurality of angles, θ, around the body of an injection port. Circumferentially staggered injection nozzles can inject a chemical at a plurality of angles theta around the circumference of a production tubing string 13, for example. As in other embodiments, the injection nozzle tips may be of any suitable size and of any suitable shape and the size and shape of the injection nozzle tips may influence the velocity of the injected chemical 2.

Figure 9:
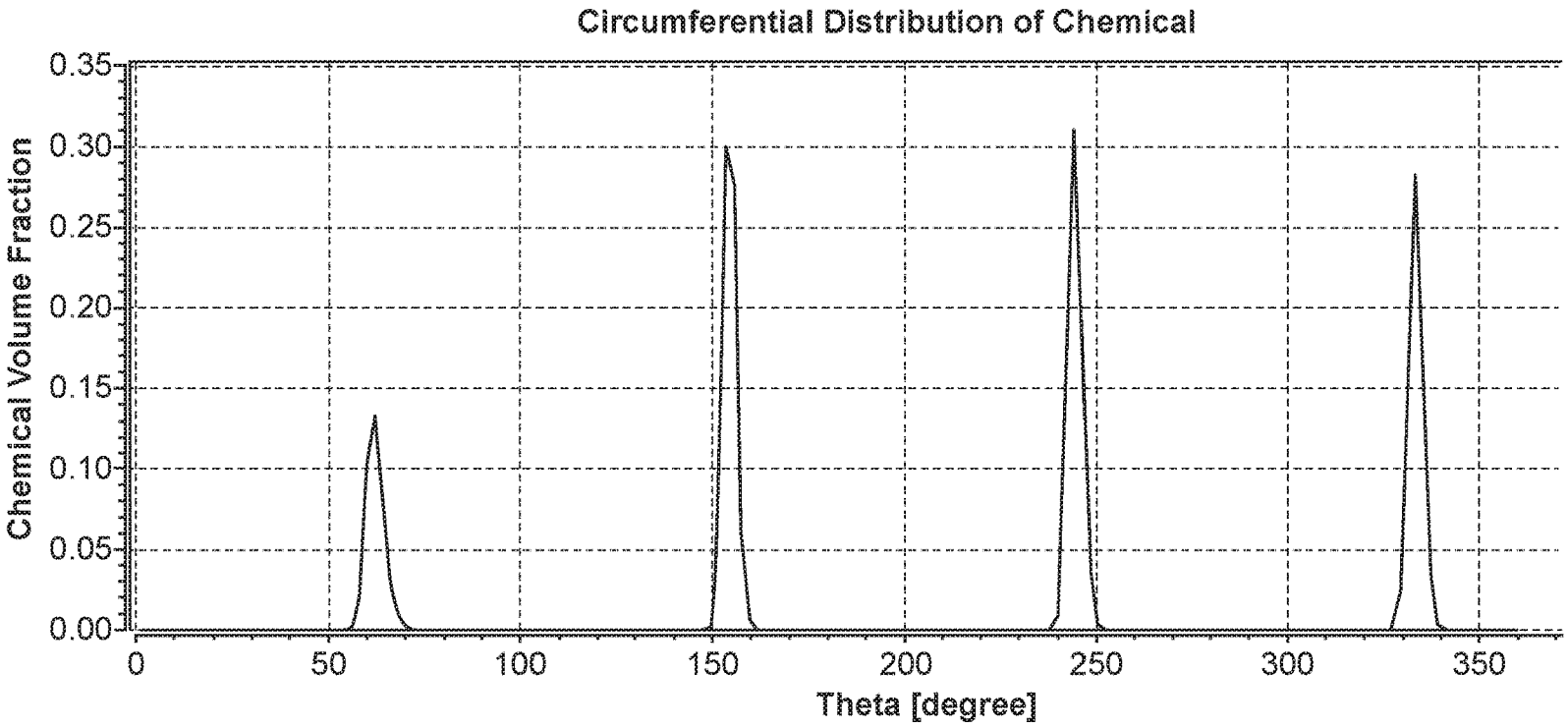
FIG. 9: is a plot of chemical volume fraction versus theta showing the circumferential distribution of an injected chemical along an inner circumference of a tubing string via a plurality of injection ports.

FIG. 9 is a plot of chemical volume fraction versus theta showing the circumferential distribution of an injected chemical along an inner circumference of a tubing string via a plurality of injection ports, as illustrated for example in FIG. 5. More specifically, the plot shows the chemical volume fraction as a function of the circumferential angle theta, from 0 to 360 degrees, for a single row of injection nozzles on a transverse plane, one foot downstream of the injection ports. The chemical volume fraction of injected chemical has a relatively narrow distribution about the point of injection.

Figure 10:
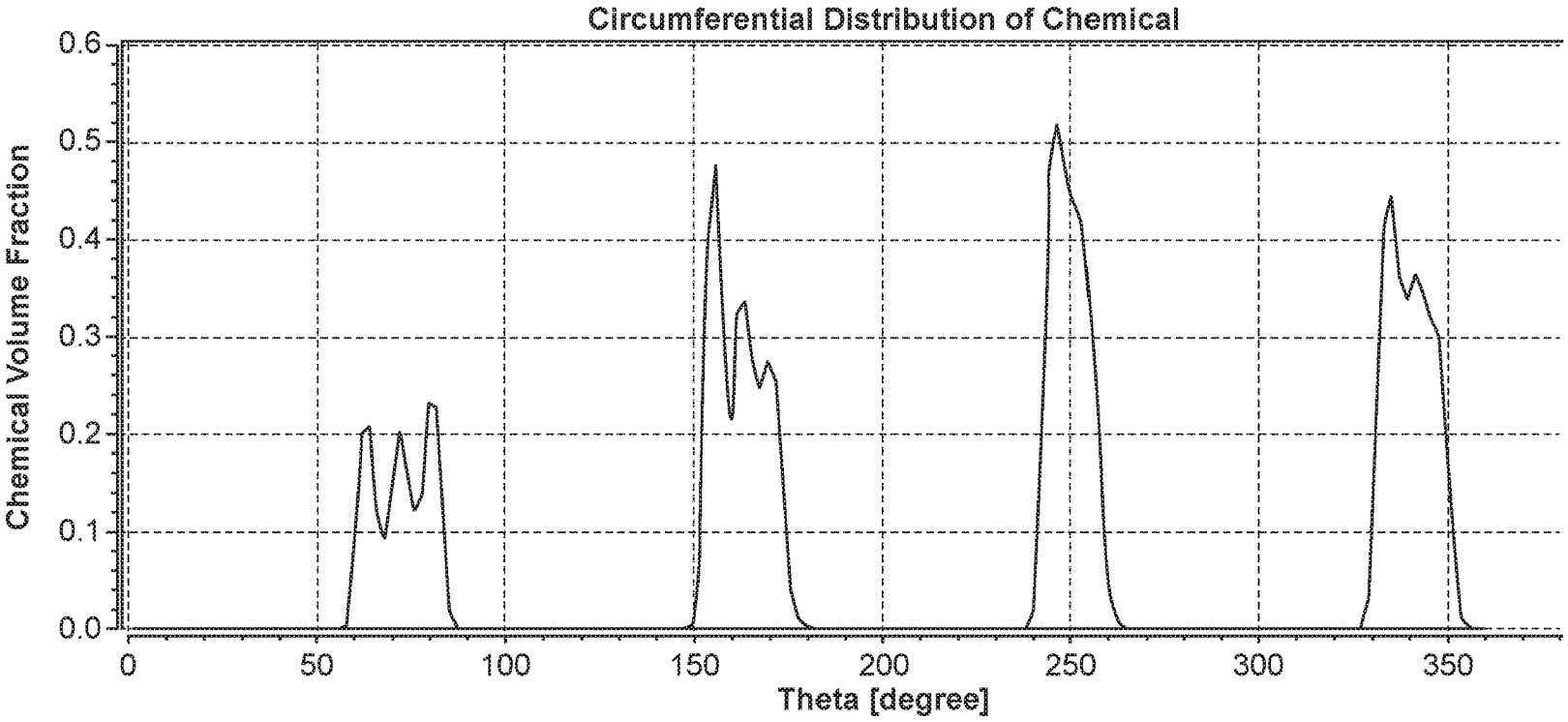
FIG. 10: is a plot of chemical volume fraction versus theta showing the circumferential distribution of an injected chemical along an inner circumference of a tubing string via a plurality of injection ports, each having a plurality of injection tips.

FIG. 10 is a plot of chemical volume fraction versus theta showing the circumferential distribution of an injected chemical along an inner circumference of a tubing string via a plurality of injection ports, each having a plurality of injection tips, as illustrated for example in FIGS. 8A and 8B. More specifically, the plot shows the chemical volume fraction as a function of the circumferential angle theta, from 0 to 360 degrees, for three staggered rows of injection nozzles on a transverse plane, one foot downstream of the injection ports. The chemical volume fraction of injected chemical has a comparatively broader distribution about the points of injection.

As can be seen by comparing FIGS. 4, 9, and 10, CFD simulations of a single injection nozzle, a single row of injection nozzles, and multiple rows of injection nozzles demonstrates that, for the same total flow rate of injected chemical, a much better distribution of the chemical on the circumference is achieved. It is important to note that the comparison is based on the same total flow rate of injected chemical. Importantly, it was discovered that the peak chemical concentration increased significantly upon adding additional nozzles. For example, compare the peak chemical volume fraction in FIG. 4, of about 0.016, with the peak chemical volume fraction in FIG. 9, of about 0.31, with the peak chemical volume fraction in FIG. 10 of about 0.52. Without wishing to be bound by theory, it is believed that the significantly increased peak chemical concentration is due to the reduced penetration of the chemical into the cross-stream fluid (i.e. the oil) as a result of the weakened momentum of the chemical jet associated with the reduction in the injected chemical mass flow rate per port. The increase in chemical concentration around the walls of the tubing string is also highly desirable to prevent the deposition and or accumulation of scale on tubing surface. Therefore, by increasing the number of ports and distributing the ports on the circumference of the tubing string, two important goals may be achieved. First, an enhanced chemical concentration at the walls may be achieved. Since the chemical, at a given mass flow rate, has less velocity, it does not penetrate as deeply into the tubing string. Instead, the chemical remains near the inner wall of the tubing string. Secondly, the diffusion path needed for the chemical to cover or to fill the inner circumference of the tubing string is decreased. Reducing the diffusion path aids the slow chemical diffusion process. Instead of needing to diffuse throughout the entire composition inside the tubing string, the chemical is injected at multiple locations around the circumference of the tubing string.

Figure 11:
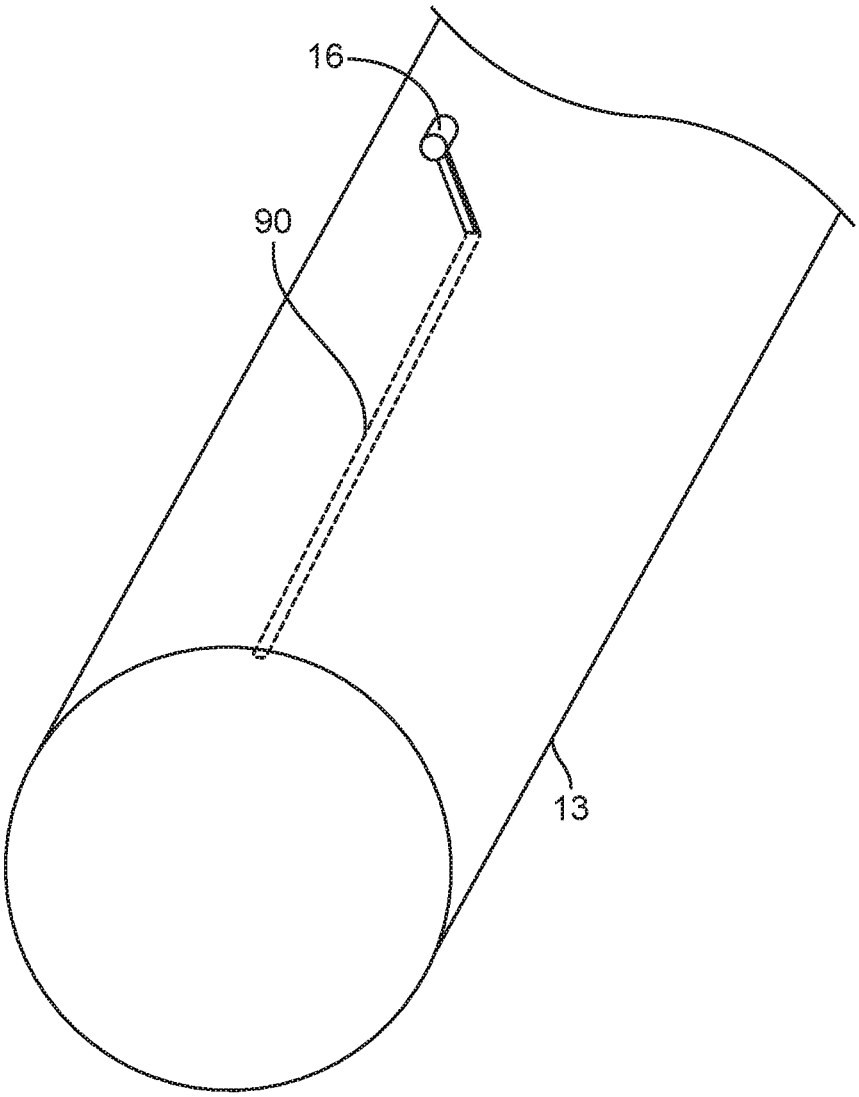
FIG. 11: is a schematic perspective-view diagram of a an injected chemical along an inner circumference of a tubing string via a single injection port.

FIG. 11 is a schematic perspective-view diagram of an injected chemical along an inner circumference of a tubing string via a single injection port, as illustrated in FIG. 1, for example. Injected chemical 90 is shown streaking along an internal surface of the production tubing string 13 from the injection port 16.

Figure 12:
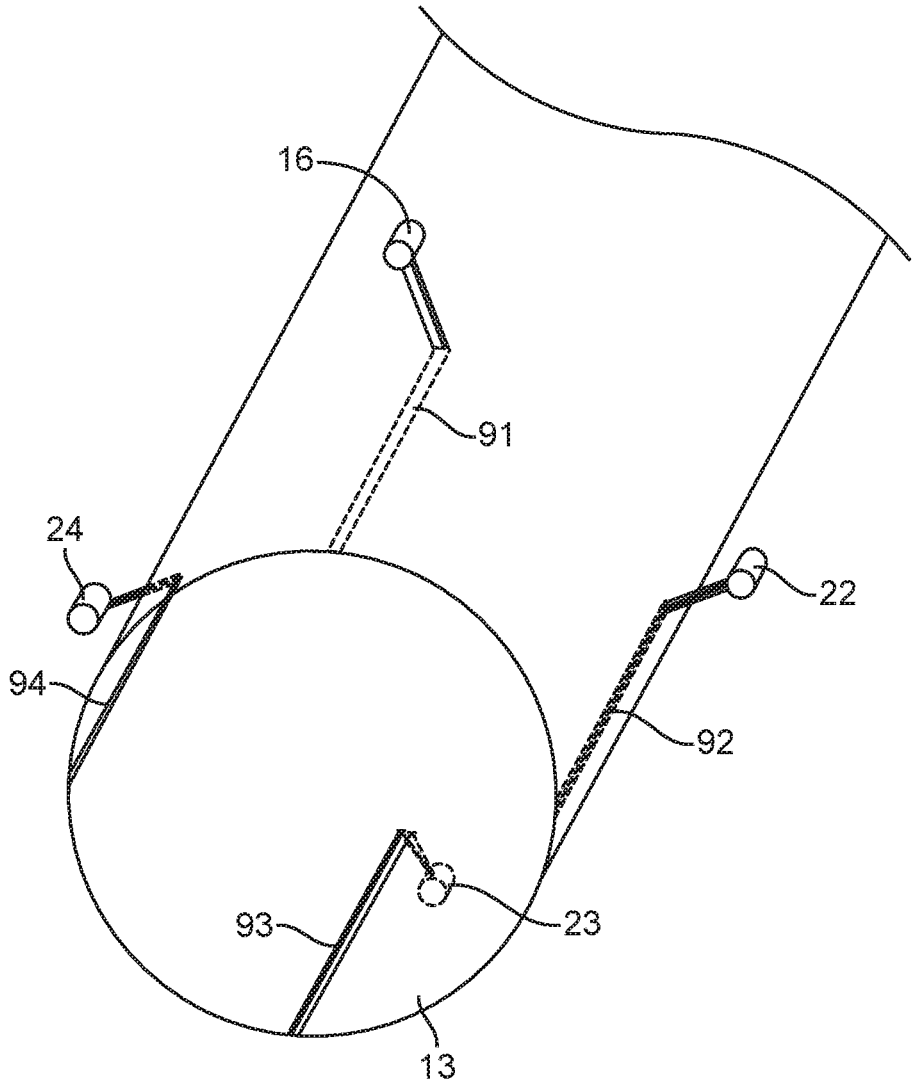
FIG. 12: is a schematic perspective-view diagram of an injected chemical along an inner circumference of a tubing string via a plurality of injection ports.

FIG. 12 is a schematic perspective-view diagram of an injected chemical along an inner circumference of a tubing string via a plurality of injection ports, as illustrated in FIG. 5, for example. A first portion 91 of injected chemical is shown streaking along an internal surface of the production tubing string 13 from the injection port 16. A second portion 92 of injected chemical is shown streaking along an internal surface of the production tubing string 13 from the injection port 22. A third portion 93 of injected chemical is shown streaking along an internal surface of the production tubing string 13 from the injection port 23. A fourth portion 94 of injected chemical is shown streaking along an internal surface of the production tubing string 13 from the injection port 24.

Figure 13:
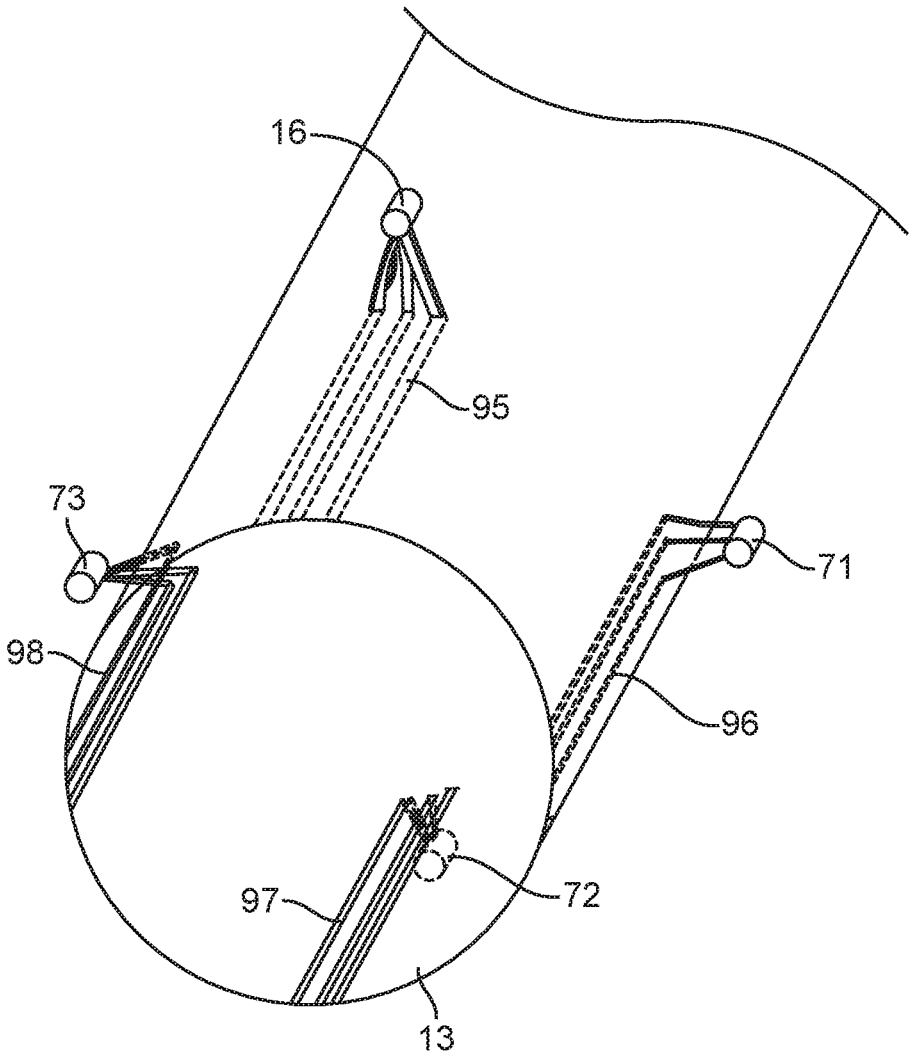
FIG. 13: is a schematic perspective-view diagram of an injected chemical along an inner circumference of a tubing string via a plurality of injection ports, each having a plurality of injection tips.

FIG. 13 is a schematic perspective-view diagram of an injected chemical along an inner circumference of a tubing string via a plurality of injection ports, each having a plurality of injection tips, as illustrated in FIGS. 8A and 8B for example. A first grouped portion 95 of injected chemical, is shown streaking along an internal surface of the production tubing string 13 from the injection port 16. As illustrated, the first grouped portion 95 comprises three discrete streaks, but as shown in FIG. 10, the streaks may bleed together, depending on the positioning of the injection tips and based on the relative densities of the injected chemical and the well-bore fluid. A second grouped portion 96 of injected chemical, is shown streaking along an internal surface of the production tubing string 13 from the injection port 71. A third grouped portion 97 of injected chemical, is shown streaking along an internal surface of the production tubing string 13 from the injection port 72. A fourth grouped portion 98 of injected chemical, is shown streaking along an internal surface of the production tubing string 13 from the injection port 73. As with the first grouped portion 95, the second grouped portion 96, the third grouped portion 97, and/or the fourth grouped portion 98 may include discrete or blended streaks. Indeed, all of the grouped portions may blend together so that the entire internal surface of the production tubing string is substantially covered with injected chemical.

Figure 14:
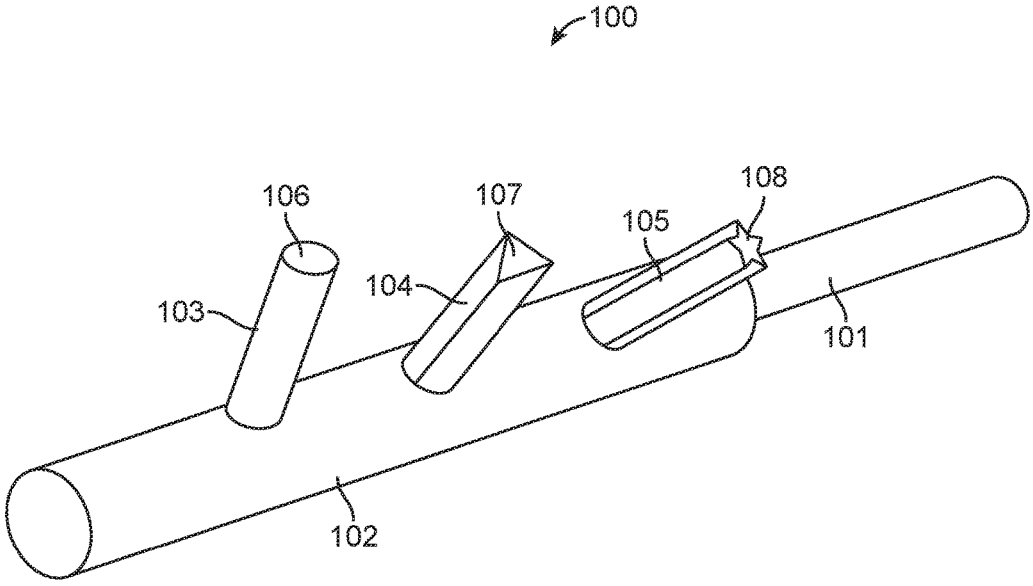
FIG. 14: is a schematic perspective-view diagram of an injection port having a plurality of injection tips, each tip having a unique shape.

FIG. 14 is a schematic perspective-view diagram of an injection port 100 having a plurality of injection tips, each tip having a unique shape. More specifically, the injection port 100 may be fluidically coupled with an injection line 101 through which injected chemical 2 may be supplied. The injection port 100 may include an injection port body 102 and a plurality of injection nozzles 103, 104, 105. Each of the injection nozzles 103, 104, 105 may have an injection nozzle tip 106, 107, 108. The injection nozzle tips 106, 107, 108 may be the same or different. For example a first injection nozzle tip 106 may have a circular or oval shape, a second injection nozzle tip 107 may have a triangular shape, and a third injection nozzle tip 108 may have a star shape. Other shapes may be employed. For example a nozzle tip may be circular, oval, or fan-shaped. The tips may be optimized to help condition the flow and to help the injected chemical effectively lay on the internal surface of the production tubing string and to diffuse as much as possible in a circumferential direction. The size and shape of each tip may be adjusted depending on the flow velocity of the injected chemical and based on the relative densities of the injected chemical and the well-bore fluid. Improved chemical distribution over tubing string walls may reduce scale deposition and buildup and as a result minimize any potential production losses, mitigating the need for costly remedial services.

Figure 15:
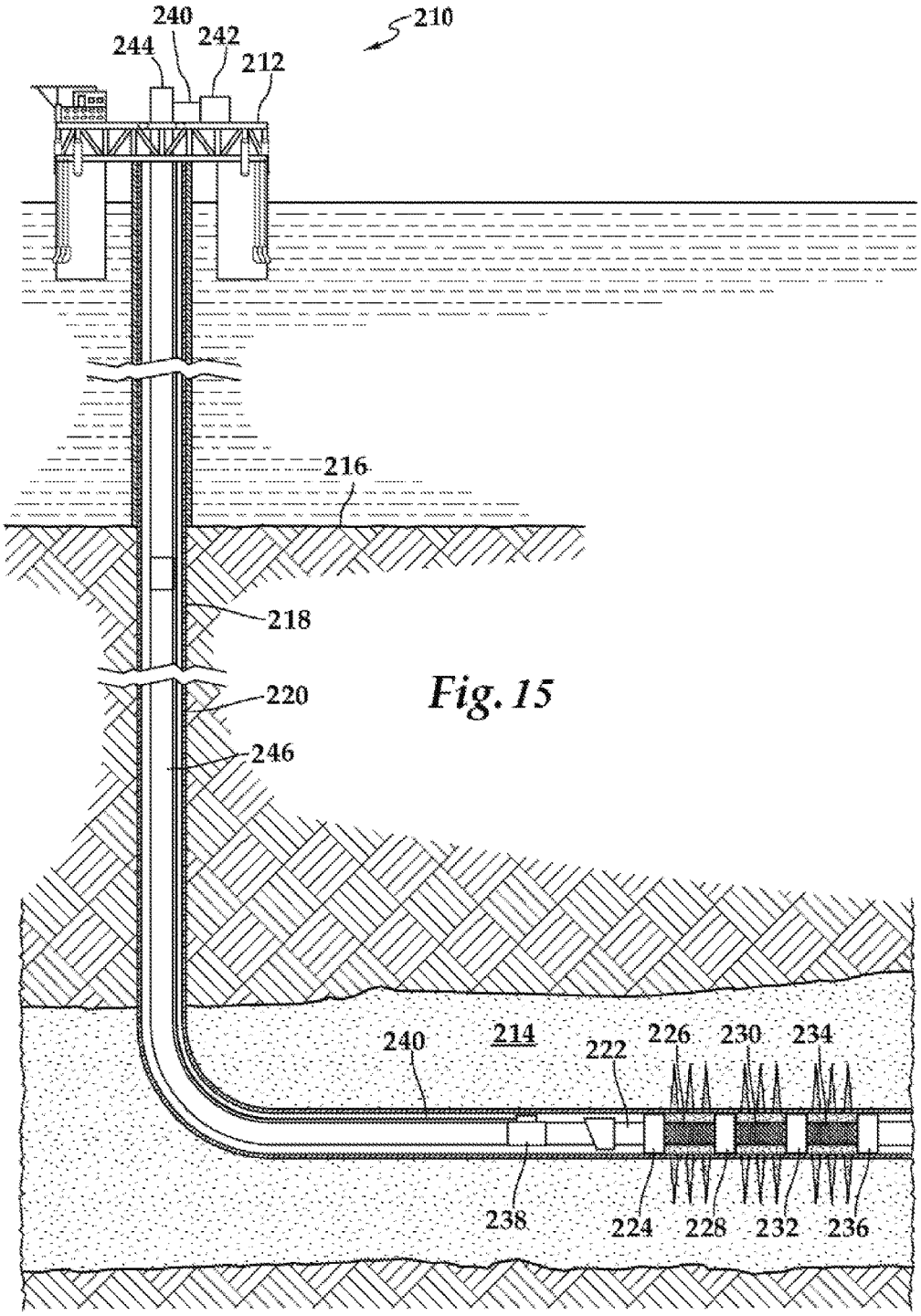
FIG. 15: is a schematic illustration of an offshore platform operating a downhole chemical injection system.

FIG. 15 is a schematic illustration of an offshore platform operating a downhole chemical injection system. While the making and using of various embodiments of the present disclosure are discussed in detail, it should be appreciated that the present disclosure provides many applicable inventive concepts, which can be embodied in a wide variety of specific contexts. The specific embodiments discussed herein are merely illustrative and do not delimit the scope of the present disclosure.

Referring to FIG. 15, a downhole chemical injection system is being operated in a well positioned beneath an offshore oil or gas production platform that is schematically illustrated and generally designated 210. A semi-submersible platform 212 is centered over submerged oil and gas formation 214 located below sea floor 216. A wellbore 218 extends through the various earth strata including formation 214 and has a casing string 220 cemented therein. Disposed in a substantially horizontal portion of wellbore 218 is a completion assembly 222 that includes various tools such as a packer 224, sand control screen assembly 226, packer 228, sand control screen assembly 230, packer 232, sand control screen assembly 234 and packer 236. In addition, completion assembly 222 includes a chemical injection mandrel 238 of the present disclosure having a density barrier for preventing migration of production fluid into the chemical injection system regardless of the directional orientation of wellbore 218. In the illustrated embodiment, a chemical injection line 240 extends from a surface installation depicted as a treatment fluid pump 242 passing through a wellhead 244. Chemical injection line 240 delivers treatment chemicals from pump 242 to chemical injection mandrel 238. Applications of the chemical injection system include, for example, scale removers, asphaltines, emulsions, hydrates, defoaming, paraffin, scavengers, corrosion, demulsifiers and the like. Completion assembly 222 is interconnected within a tubing string 246 that extends to the surface and provides a conduit for the production of formation fluids, such as oil and gas, to wellhead 244.

Importantly, as explained in detail below, even though FIG. 15 depicts the chemical injection mandrel of the present disclosure in a horizontal section of the wellbore, it should be understood by those skilled in the art that the chemical injection mandrel of the present disclosure is specifically designed for use in wellbores having a variety of directional orientations including vertical wellbores, inclined wellbores, slanted wellbores, multilateral wellbores or the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well, the downhole direction being toward the toe of the well. Also, even though FIG. 15 depicts an offshore operation, it should be understood by those skilled in the art that the chemical injection mandrel of the present disclosure is equally well suited for use in onshore operations. Further, even though FIG. 15 depicts a cased hole completion, it should be understood by those skilled in the art that the chemical injection mandrel of the present disclosure is equally well suited for use in open hole completions. In addition, even though FIG. 15 depicts an single chemical injection installation with a dedicated chemical injection line, it should be understood by those skilled in the art that the chemical injection mandrel of the present disclosure is equally well suited for use in multipoint chemical injection installations where two or more chemical injection mandrels are installed that share a common chemical injection line.

Numerous examples are provided herein to enhance understanding of the present disclosure. A specific set of statements are provided as follows.

Statement 1: A downhole chemical injection system comprising: a first injection port fluidically coupled with a chemical injection line and having a first radially extending injection nozzle fluidically coupled with a tubing string; and a second injection port fluidically coupled with the chemical injection line and having a second radially extending injection nozzle fluidically coupled with the tubing string and circumferentially offset from the first radially extending injection nozzle about a circumference of the tubing string.

Statement 2: A downhole chemical injection system is disclosed according to Statement 1, further comprising: the first injection port further including a third radially extending injection nozzle fluidically coupled with the tubing string and circumferentially offset from the first radially extending injection nozzle and the second radially extending injection nozzle about a circumference of the tubing string.

Statement 3: A downhole chemical injection system is disclosed according to Statement 2, further comprising: the second injection port further including a fourth radially extending injection nozzle fluidically coupled with the tubing string and circumferentially offset from the first radially extending injection nozzle, the second radially extending injection nozzle, and the third radially extending injection nozzle about a circumference of the tubing string.

Statement 4: A downhole chemical injection system is disclosed according to Statements 1-3, wherein at least one of the first radially extending injection nozzle and the second radially extending injection nozzle comprises an injection tip having a cross-sectional shape selected from the group consisting of a circle, an oval, and a triangle.

Statement 5: A downhole chemical injection system according to Statements 1-4, further comprising at least one additional injection port fluidically coupled with the chemical injection line and fluidically coupled with the production tubing string to inject the chemical into the production tubing string, the at least one additional injection port comprising as least one additional radially extending injection nozzle.

Statement 6: A downhole chemical injection system is disclosed according to Statements 1-5, the chemical injection line comprising a check valve disposed between the surface treatment fluid pump and the first injection port and the second injection port.

Statement 7: A downhole chemical injection system is disclosed according to Statement 6, further comprising a density barrier fluidically positioned between the check valve and the first injection port and the second injection port, the density barrier having an axial loop and a circumferential loop relative to the production tubing string, thereby restricting migration of production fluid from the first injection port and the second injection port to the check valve regardless of the directional orientation of the well.

Statement 8: A downhole chemical injection system is disclosed according to Statement 7, wherein the axial loop comprises a pair of axially extending tubing sections.

Statement 9: A downhole chemical injection system is disclosed according to Statement 8, further comprising an extended injection line fluidically coupled with at least one of the pair of axially extending tubing sections, and wherein the second injection port is fluidically coupled with the extended injection line.

Statement 10: A downhole chemical injection system is disclosed according to Statement 9, further comprising at least one additional injection port fluidically coupled with the extended injection line.

Statement 11: A method comprising: disposing a downhole chemical injection system in a well, the downhole chemical injection system fluidically coupled with a tubing string, the downhole chemical injection system comprising: a first injection port fluidically coupled with a chemical injection line and having a first radially extending injection nozzle fluidically coupled with the tubing string; and a second injection port fluidically coupled with the chemical injection line and having a second radially extending injection nozzle fluidically coupled with the tubing string and circumferentially offset from the first radially extending injection nozzle about a circumference of the tubing string; pumping a chemical from a surface treatment pump through the chemical injection line; and injection the chemical into the production tubing string via the first radially extending injection nozzle and the second radially extending injection nozzle.

Statement 12: A method is disclosed according to Statement 11, wherein the first injection port further includes a third radially extending injection nozzle fluidically coupled with the tubing string and circumferentially offset from the first radially extending injection nozzle and the second radially extending injection nozzle about a circumference of the tubing string, the method further comprising injecting the chemical into the production tubing string via the third radially extending injection nozzle.

Statement 13: A method is disclosed according to Statement 12, wherein the second injection port further including a fourth radially extending injection nozzle fluidically coupled with the tubing string and circumferentially offset from the first radially extending injection nozzle, the second radially extending injection nozzle, and the third radially extending injection nozzle about a circumference of the tubing string.

Statement 14: A method is disclosed according to Statements 11-13, wherein at least one of the first radially extending nozzle and the second radially extending injection nozzle comprises an injection tip having a cross-sectional shape selected from the group consisting of a circle, an oval, and a triangle.

Statement 15: A method is disclosed according to Statements 11-14, the downhole chemical injection system further comprising at least one additional injection port fluidically coupled with the chemical injection line and fluidically coupled with the production tubing string to inject the chemical into the production tubing string, the at least one additional injection port comprising at least one additional radially extending injection nozzle, and the method further comprising injecting the chemical into the production tubing string via the at least one additional radially extending injection nozzle.

Statement 16: A method is disclosed according to Statements 11-15, the chemical injection line comprising a check valve disposed between the surface treatment fluid pump and the first injection port and the second injection port; and a density barrier fluidically positioned between the check valve and the first injection port and the second injection port, the density barrier having an axial loop and a circumferential loop relative to the production tubing string, thereby restricting migration of production fluid from the first injection port and the second injection port to the check valve regardless of the directional orientation of the well.

Statement 17: A method is disclosed according to Statements 11-16, wherein injecting the chemical into the production tubing string comprises injecting the chemical at a plurality of positions around an inner circumference of the production tubing string.

Statement 18: A method for injecting a chemical into a production tubing string, the method comprising: fluidically coupling a downhole chemical injection system with a production tubing string and a surface treatment fluid pump via a chemical injection line, disposing the downhole chemical injection system in a well; pumping the chemical from the surface treatment pump through the chemical injection line; and injecting the chemical into the production tubing string via a plurality of injection nozzles, wherein for a given mass flow rate of the chemical from the surface treatment fluid pump, the average chemical volume fraction of the chemical injected into the production tubing string via the plurality of injection nozzles measured at about one foot downstream of the plurality of injection nozzles, is greater than a chemical volume fraction of the chemical measured at about one foot downstream of the single injection port that would be obtained by injecting the chemical into the production tubing string via only a single injection nozzle.

Statement 19: A method is disclosed according to Statement 18, wherein the average chemical volume fraction of the chemical injected into the production tubing string via the plurality of injection nozzles exceeds the chemical volume fraction of the chemical injected into the production tubing string via a single injection port by a factor of from about 10 to about 50.

Statement 20: A method is disclosed according to Statements 18 or 19, wherein the average chemical volume fraction of the chemical injected into the production tubing string via the plurality of injection nozzles exceeds the chemical volume fraction of the chemical injected into the production tubing string via a single injection port by a factor of about 30.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

It should be understood that the compositions and methods are described in terms of "comprising," "containing," or "including" various components or steps, the compositions and methods can also "consist essentially of" or "consist of" the various components and steps.

Therefore, the present disclosure is well adapted to attain the ends and advantages mentioned as well as those that are inherent therein. The particular embodiments disclosed above are illustrative only, as the disclosed systems, methods, and/or apparatus may be modified and practiced in different but equivalent manners apparent to those skilled in the art having the benefit of the teachings herein. Although individual embodiments are discussed, the disclosure covers all combinations of all those embodiments. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A method comprising:

disposing a downhole chemical injection system in a well, the downhole chemical injection system coupled with an exterior surface of a tubing string, the downhole chemical injection system comprising:

a first injection port fluidically coupled with a chemical injection line and having a first radially extending injection nozzle extending to an interior of the tubing string through the exterior surface of the tubing string and fluidically coupled with the interior of the tubing string; and a second injection port fluidically coupled with the chemical injection line and having a second radially extending injection nozzle extending to an interior of the tubing string through the exterior surface of the tubing string and fluidically coupled with the interior of the tubing string and circumferentially offset from the first radially extending injection nozzle about a circumference of the tubing string;

pumping a chemical from a surface treatment pump through the chemical injection line; and injecting the chemical into the tubing string via the first radially extending injection nozzle and the second radially extending injection nozzle.

2. The method according to claim 1, wherein the first injection port further includes a third radially extending injection nozzle extending to an interior of the tubing string through the exterior surface of the tubing string and fluidically coupled with the tubing string and circumferentially offset from the first radially extending injection nozzle and the second radially extending injection nozzle about a circumference of the tubing string, the method further comprising injecting the chemical into the tubing string via the third radially extending injection nozzle.

3. The method according to claim 2, wherein the second injection port further including a fourth radially extending injection nozzle extending to an interior of the tubing string through the exterior surface of the tubing string and fluidically coupled with the tubing string and circumferentially offset from the first radially extending injection nozzle, the second radially extending injection nozzle, and the third radially extending injection nozzle about a circumference of the tubing string, the method further comprising injecting the chemical into the tubing string via the fourth radially extending injection nozzle.

4. The method according to claim 1, wherein at least one of the first radially extending injection nozzle and the second radially extending injection nozzle comprises an injection tip having a cross-sectional shape selected from the group consisting of a circle, an oval, and a triangle.

5. The method according to claim 1, the downhole chemical injection system further comprising at least one additional injection port fluidically coupled with the chemical injection line, extending to an interior of the tubing string through the exterior surface of the tubing string, and fluidically coupled with the tubing string to inject the chemical into the tubing string, the at least one additional injection port comprising at least one additional radially extending injection nozzle, and the method further comprising injecting the chemical into the tubing string via the at least one additional radially extending injection nozzle.

6. The method according to claim 1, the chemical injection line comprising a check valve disposed between the surface treatment fluid pump and the first injection port and the second injection port; and a density barrier fluidically positioned between the check valve and the first injection port, the density barrier having an axial loop and a circumferential loop relative to the tubing string, thereby restricting migration of fluid from the first injection port and the second injection port to the check valve regardless of the directional orientation of the well.

7. The method according to claim 1, wherein injecting the chemical into the tubing string comprises injecting the chemical at a plurality of positions around an inner circumference of the tubing string.

8. A method for injecting a chemical into a tubing string, the method comprising:

fluidically coupling a downhole chemical injection system with a tubing string and a surface treatment fluid pump via a chemical injection line, disposing the downhole chemical injection system in a well;

pumping the chemical from the surface treatment pump through the chemical injection line; and injecting the chemical into an interior of the tubing string via a plurality of injection nozzles extending to the interior of the tubing string through an exterior surface of the tubing string and distributed radially about the tubing string, wherein the injection of the chemical via the plurality of injection nozzles extending to the interior of the tubing string through an exterior surface of the tubing string and distributed radially about the tubing string promotes distribution of the chemical and/or mixing of the chemical with fluid flowing through the tubing string.

9. A method comprising:

disposing a downhole chemical injection system in a well, the downhole chemical injection system fluidically coupled with a tubing string, the downhole chemical injection system comprising:

a chemical injection line including a pair of axially extending tubing sections;

a first injection port fluidically coupled with the chemical injection line and having a first radially extending injection nozzle fluidically coupled with the tubing string;

an extended injection line fluidically coupled with at least one of the pair of axially extending tubing sections; and a second injection port fluidically coupled with the extended injection line and having a second radially extending injection nozzle fluidically coupled with the tubing string and circumferentially offset from the first radially extending injection nozzle about a circumference of the tubing string;

pumping a chemical from a surface treatment pump through the chemical injection line; and injecting the chemical into the production tubing string via the first radially extending injection nozzle and the second radially extending injection nozzle.

* * * * *